United States Patent [19]

Field

[11] Patent Number: 4,908,881

[45] Date of Patent: Mar. 20, 1990

[54] FINGER GUARD

[76] Inventor: Frank P. Field, 854 Napoli Dr., Pacific Palisades, Calif. 90272

[21] Appl. No.: 254,401

[22] Filed: Oct. 6, 1988

[51] Int. Cl.[4] ..... A41D 13/08

[52] U.S. Cl. ..... 2/21; 2/163

[58] Field of Search ..... 2/21, 161 R, 163, 164, 2/165, 169, 159, 409; 15/227; 128/157; 294/25

[56] References Cited

U.S. PATENT DOCUMENTS

| | | | |
|---|---|---|---|
| 925,207 | 6/1909 | Lindner | 2/163 |
| 1,010,283 | 11/1911 | Loy | 2/163 |
| 1,513,237 | 10/1924 | Green | 2/159 X |
| 1,949,755 | 3/1934 | Mitchell | 2/159 |
| 2,335,320 | 11/1943 | Swietek | 2/163 |
| 2,725,570 | 12/1955 | Penna | 2/163 |
| 3,348,541 | 10/1967 | Loebeck | 2/21 X |
| 4,133,054 | 1/1979 | Harper | 2/409 X |
| 4,369,528 | 1/1983 | Vest et al. | 2/409 X |

FOREIGN PATENT DOCUMENTS

| | | | |
|---|---|---|---|
| 763204 | 4/1934 | France | 2/163 |
| 111765 | 12/1917 | United Kingdom | 2/163 |

*Primary Examiner*—Werner H. Schroeder
*Assistant Examiner*—Sara M. Current
*Attorney, Agent, or Firm*—Stetina and Brunda

[57] ABSTRACT

An aesthetically pleasing finger and/or toe guard and method of fabricating the same is disclosed for protection of a user's fingertip and/or fingernail or to protect and cover an injured finger or toe.

3 Claims, 1 Drawing Sheet

FINGER GUARD

BACKGROUND OF THE INVENTION

This invention pertains generally to the art of protective wearing apparel and more particularly to a protective finger guard and method of manufacturing same.

It is presently well-known for people, primarily women, to synthetically bond artificial fingernails over top of their natural nails. Such artificial fingernails typically comprise layers of acrylic or other synthetic material applied over top of the fingernail so as to extend some distance beyond the fingertip. One problem associated with the use of artificial fingernails, or even long natural fingernails, is that they tend to break or become damaged as the user goes about the normal day-to-day endeavours which involve handling of rigid, sharp, or abrasive items and the like.

Although one means of avoiding damage to one's artifical fingernails may be to simply wear gloves when handling items which may be deleterious to the nails, the routine wearing of full gloves is often undesireable.

Also, when injuries (e.g. cuts, abrasions, minor burns) to the finger or thumb occur it is often desirable to cover and protect the injured digit. However, traditional bandages, finger cots, and other typical wound dressings are often displeasing or unsightly in appearance and tend to call unnecessary attention to the injury.

Accordingly, there remains a need in the art for fashionably acceptable yet protectively functional finger protecters which are capable of preventing damage to a wearer's fingernails and/or covering and protecting injured digits.

BRIEF DESCRIPTION OF THE INVENTION

Present invention comprises a finger guard which may be slipped over the distal portion of a finger so as to protect the underlying fingernail and/or fingertip. Although the invention is primarily applicable to fingers, it may be used on any anatomical digit including toes.

In accordance with the invention, there is provided a generally cylindrical sheath member formed of generally rigid or pliable material and configured to conform to the anatomical contours of the human fingertip.

Further in accordance with the invention, the finger guard may be decorated with sequins, beads, or other fashionable accoutrements. Such accoutrements will preferably be fixed to the outer surface of the sheath so as to be readily visible and aesthetically pleasing.

Still further in accordance with the invention, a fingernail-shaped insert may be detachably affixed to the outer surface of the finger guard, so as to approximate the appearance of a human fingernail. Such detachably connectable fingernail-shaped insert may be prepared in various colors and/or designs for purposes of further enhancing the appearance of the finger guard.

Even further in accordance with the invention, there is provided a digit guard for protecting and promoting healing of injured fingers and/or toes. Such digit guard may be positioned over an existing bandage, splint, or other dressing so as to conceal such unsightly dressing and to provide an aesthetically pleasing yet functional cover and protector for the injured digit.

Still further in accordance with the invention, there is provided a means for manufacturing finger guards of the foregoing character. Such manufacturing method comprises the steps of:

A. Providing a generally cylindrical or tubular section of flexible or semiflexible material;

B. Diagonally transecting the cylindrical tube, at predetermined intervals, so as to form a number of individual segments; and C. Sewing or otherwise fusing the opposing edges of one diagonally cut end of each individual segment so as to form a closed pouch-like distal tip, generally shaped to snuggly receive and correspond to the anatomical shape of a human finger.

Further yet, in accordance with the invention, the above-described manufacturing process may include the additional step of attaching sequins, beads, false fingernail inserts, or other aesthetically pleasing decorative items to the exterior of the finger sheath so as to form a decorative finger guard.

The principal object of the invention is to provide a means for protecting the distal portion of a finger and any natural or artificial fingernail attached thereto.

Yet another object of the invention is to provide a finger guard or finger protector which incorporates aesthetically decorative accoutrements on the exterior thereof so as to be aesthetically pleasing and fashionable as well as utilitarian.

Still another object of the invention is to provide a digit guard capable of protecting and promoting healing of injured fingers and/or toes.

Yet another object of the invention is to provide a finger guard of the foregoing character wherein an exterior fingernail-shaped insert may be attached to the upper surface of the finger sheath so as to give the appearance of a natural or artifical fingernail.

Further objects and advantages of the invention will become apparent to those skilled in the art upon reading and understanding of the following detailed description and the accompanying drawings.

DETAILED DESCRIPTION OF THE PREFERRED EMBODIMENTS

Figure 1:
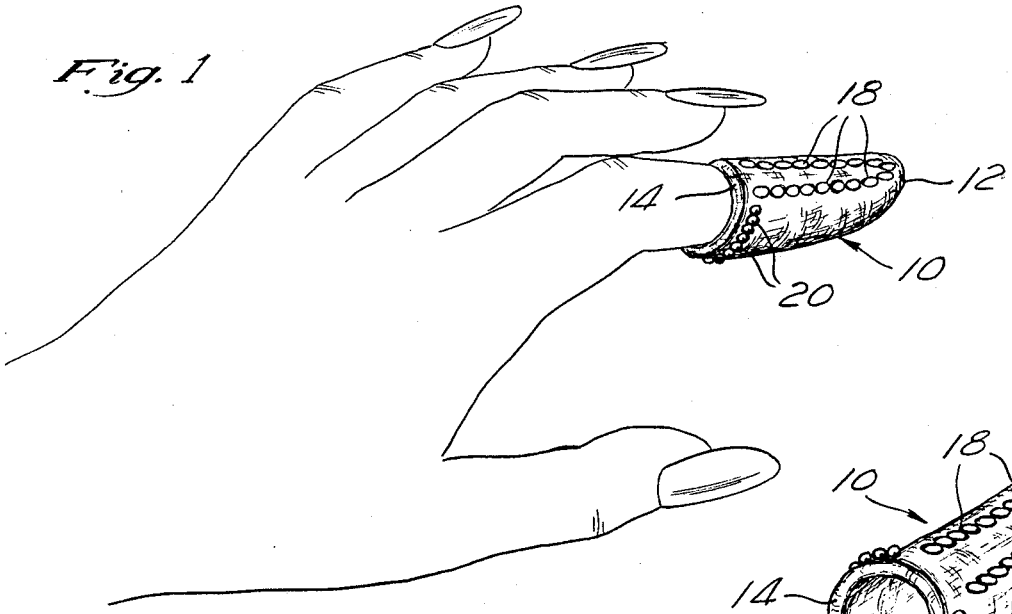
FIG. 1 is a perspective view of the human hand bearing a preferred finger guard of the present invention on the index finger thereof.
Figure 2:
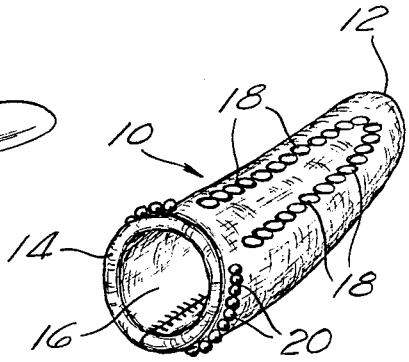
FIG. 2 is a perspective view of a preferred finger guard of the present invention.

The following detailed description is provided for the purpose of describing presently preferred embodiments of the invention only and is not intended to limit the invention in any way. Referring now to FIGS. 1 and 2, a preferred finger guard of the present invention comprises a sheath-like device adapted to fit over the distal portion of a human finger. Such sheath-like device may be formed of rigid or pliable material such as plastic or cloth fabric. Each sheath-like finger guard is shaped to fit slideably over the distal portion of a human finger or thumb. Accordingly, the finger guard of the present invention comprises a sheath-like material having a closed distal tip 12 and an open proximal end 14 and a generally hollow interior 16.

In the preferred embodiment shown in FIGS. 1–2, a plurality of sequins 18 are arranged on the upper surface of the finger guard while a row of beads 20 extend generally around the proximal edge thereof. Such sequins 18 and beads 20 provide a decorative and fashionable appearance. The proximal edge 14 of the sheath is rolled under and sewn firmly so as to form a smooth, annular opening through which the user's fingertip may be advanced into the interior 16 of the sheath.

Figure 3:
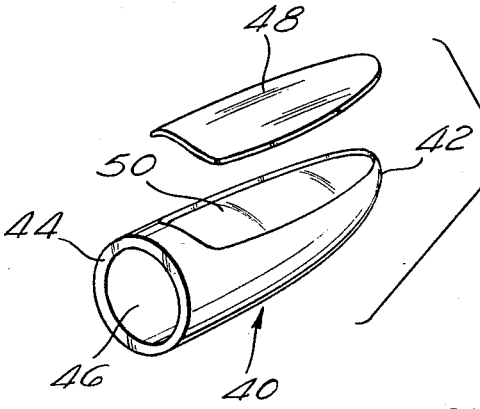
FIG. 3 is a perspective exploded view of a second preferred finger guard of the present invention bearing an artificial fingernail insert.

As shown in FIG. 3, an alternative preferred embodiment of the invention comprises a semi-rigid sheath 40 formed of slightly pliable plastic or other material. Such semi-pliable sheath 40 will have a closed distal end 42, an open proximal end 44, and a hollow inner bore 46. Such configuration permits the distal fingertip to be advanced into the inner bore 46 in the same manner as described in relation to the first preferred embodiment shown in FIGS. 1 and 2.

A false fingernail-shaped insert 48 may be detachably mounted within a recessed notch 50 formed on the upper surface of the sheath 40. Such fingernail-shaped insert 48 may be formed of rigid plastic or similar material and may be prepared in various colors and designs for aesthetic purposes.

Figure 4:
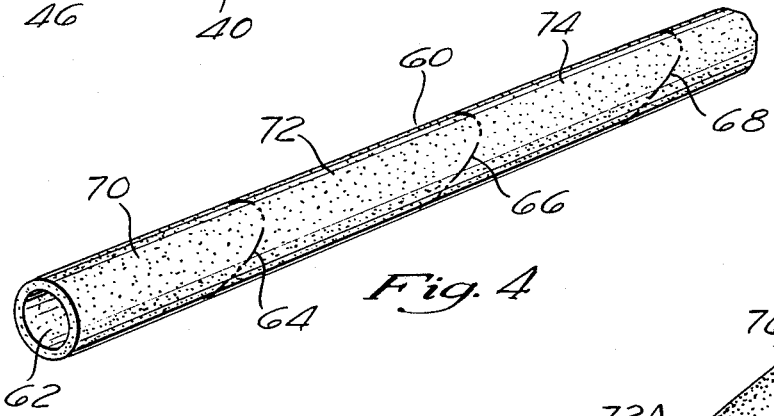
FIG. 4 is a perspective view of a length of cylindrical fabric employed in manufacturing finger guards of the present invention.
Figure 5:
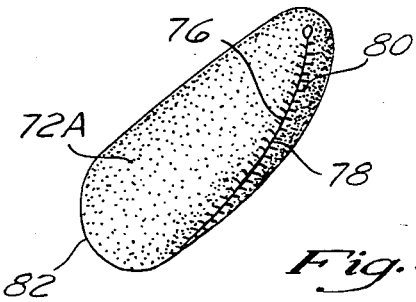
FIG. 5 is a perspective view of the underside of a preferred finger guard of the present invention showing the manner in which the underside seam thereof is formed and joined together during the preferred manufacturing process of the invention.

The present invention also encompasses a novel means whereby the finger guards of this present invention may be manufactured. Referring to FIGS. 4 and 5, in accordance with the manufacturing method of the invention, a cylinder 60 of flexible fabric or semi-pliable material may be utilized to reproduceably manufacture a large number of individual finger guards.

Such cylinder 60 has a generally hollow interior 62 therein. Diagonal transverse cuts 64, 66, 68 are made at predetermined intervals along the length of the cylinder. Such transverse cuts 64, 66, and 68 result in the formation of individual segments 70, 72 and 74. Each individual segment is specifically sized to be individually formed into a separate finger protector. Accordingly, one of the diagonally cut ends of each such segment will be closed by sewing or otherwise joining the generally arcuate opposing lateral edges 76, 78 of one diagonally arcuate cut end so as to form a generally arcuate underside seam 80 along the underside of the distal tip of the finger guard. Such arcuate seam 80 will generally correspond with the anatomical profile of a human fingertip. Any angularly cut or excess material which entends from the other end of the individual segment may then be rolled under and sewn or hemmed so as to form the desired straight cut annular opening at the proximal end 82 of the finger guard 72A. After the desired finger guard 72A has been so formed, any desired decorative accoutrements such as sequins, spangles, beads, artificial fingernails, etc. may be applied and attached to the exterior surface thereat.

Although the invention has been described herein with particular reference to specific prefered embodiments, it must be appreciated that various alterations and modifications may be made without departing from the spirit and scope of the invention. Accordingly, it is intended to include all such modifications and alterations within the scope of the following claims and the equivalents thereof.

What is claimed is:

1. A method of manufacturing a digit guard, said method comprising the steps of:

(a) providing a generally tubular section of formable material;

(b) diagonally transecting said tubular section at predetermined intervals so as to form a number of individual segments, each such segment having at least one diagonally cut end;

(c) fusing the opposing edges of one diagonally cut end of each individual segment so as to form a generally hollow pouch having one closed end and one open end.

2. The method of claim 1 further comprising the step of:

attaching selective decorative accoutrements to said hollow pouch so as to form a digit guard having a desired external appearance.

3. The method of claim 1 further comprising the step of:

hemming the open end of said pouch so as to form a smooth annular opening thereunto.

* * * * *